US007124548B2

(12) United States Patent
Pressutti et al.

(10) Patent No.: US 7,124,548 B2
(45) Date of Patent: Oct. 24, 2006

(54) FOLDED HIGH-PROFILE RIDGE COVER, AND METHOD OF MAKING

(76) Inventors: Joseph Pressutti, 3441 S. Willow, Fresno, CA (US) 93725; Kenneth Engelman, 975 W. National Ave., Clovis, CA (US) 93612; Lawrence Penner, 3441 S. Willow, Fresno, CA (US) 93725

( * ) Notice: Subject to any disclaimer, the term of this patent is extended or adjusted under 35 U.S.C. 154(b) by 0 days.

(21) Appl. No.: 10/647,989

(22) Filed: Aug. 26, 2003

(65) Prior Publication Data

US 2005/0055902 A1 Mar. 17, 2005

(51) Int. Cl.
*E04D 1/30* (2006.01)

(52) U.S. Cl. ..... 52/518; 52/745.19; 52/528

(58) Field of Classification Search ..... 52/198, 52/518, 528, 745.19, 749.1
See application file for complete search history.

(56) References Cited

U.S. PATENT DOCUMENTS 3,913,294 A * 10/1975 Freiborg ..... 52/518
4,187,650 A * 2/1980 Poplin ..... 52/57
5,094,041 A * 3/1992 Kasner et al. ..... 52/57
5,247,771 A * 9/1993 Poplin ..... 52/518
5,365,711 A * 11/1994 Pressutti et al. ..... 52/518
5,467,568 A * 11/1995 Sieling ..... 52/518
6,357,193 B1 * 3/2002 Morris ..... 52/553
6,450,882 B1 * 9/2002 Morris et al. ..... 454/365
6,813,866 B1 * 11/2004 Naipawer, III ..... 52/518

* cited by examiner

*Primary Examiner*—Naoko Slack
*Assistant Examiner*—Basil Katcheves
(74) *Attorney, Agent, or Firm*—Terry L. Miller

(57) ABSTRACT

A centrally-folded and centrally-thickened ridge cover is formed from sheet shingle material by repeatedly back folding the material on itself to provide a thickened central portion for the ridge cover. The thickened central portion is disposed intermediate of a lower and an upper portion of the ridge cover. A plurality of inscribed transverse grooves are impressed into the work piece of sheet shingle material, to insure that the work piece folds at desired locations to form the back folds and thickened central portion of the finished ridge cover. A method of effecting the desired folding of a ridge cover work piece is also disclosed.

15 Claims, 5 Drawing Sheets

FOLDED HIGH-PROFILE RIDGE COVER, AND METHOD OF MAKING

BACKGROUND OF THE INVENTION

1. Field of the Invention

The present invention relates to a low-cost, durable and highly aesthetic high-profile ridge cover made of sheet roofing material, and to a method of making the ridge cover. This high-profile ridge cover is appropriately used for roofing, and is effective to improve the aesthetics of a shingle roof.

2. Description of the Related Art

A conventional inorganic asphalt composition ridge cover is known in accord with U.S. Pat. No. RE 36,858, owned by the assignee of the present application.

Manufacturing a ridge cover according to the U.S. Pat. No. RE 36,858 patent requires that an elongate strip or ribbon of sheet roofing material be partially cut through in the outline of the individual workpieces which will become ridge covers. Within the outline of each ridge cover workpiece, a T-shaped slit is formed by partially cutting through the work piece. Also, a plurality of transverse slits are formed along the length of the T-shaped slit in order to insure that the work piece will fold on itself at the locations of these transverse slits. The outlining, forming of the T-shaped slit, and forming of the plural transverse slits are all done while the individual workpieces are still part of the elongate strip of sheet roofing material. These cutting or slitting operations are performed by training the elongate strip about a roller having outwardly disposed knife edges protruding an appropriate distance above the roller surface, and in the shape of the slits to be formed. These knife edges are a high maintenance item in the manufacturing operation, and a reduction or elimination of the use of these knife edges for slitting operations would be an important improvement in the manufacturing of such folded ridge covers.

SUMMARY OF THE INVENTION

In view of the above, the present invention provides an improved folded ridge cover made of sheet shingle material, and in which the folding operations for effecting transverse folds in the ridge cover are accomplished without the use of a slitting operation.

Further, the present invention provides a method of making such a ridge cover, and discloses also a method of making a manufacturing intermediate article from which such a folded ridge cover may be made by the application of further manufacturing steps.

Also, this invention provides a method and resulting manufacturing intermediate article in the form of an elongate strip or ribbon of sheet shingle material, for making a subsequent manufacturing intermediate article, in which the elongate strip of sheet shingle material has impressed into it a plurality of elongate longitudinal grooves, each one of which grooves traverse a plurality of work pieces of the strip, and which grooves are effective to cause folding of the workpieces at the location of the respective groove.

Surprisingly, the Applicant has discovered that a folded ridge cover according to the present invention is best processed while the sheet shingle material is at about room temperature. This eliminates the use or warming ovens, and also removes a scheduling requirement of the conventional folded ridge covers made of sheet shingle material. That is, while the folded ridge covers made of sheet shingle material according to the known technology are best processed warm, and thus require processing either soon after the sheet shingle material itself is made (i.e., while the sheet material is still warm), or require the use of a warming oven to reheat sheet shingle material that has cooled, such is not required in the processing of a folded ridge cover according to the present invention. Because the manufacturing process is most advantageously carried out with sheet shingle material that is at about room temperature, both urgencies of scheduling and the use of a reheating oven is eliminated.

Accordingly, the present invention according to one particularly preferred embodiment provides, a folded ridge cover comprising: an elongate sheet of flexible and durable composition sheet shingle material including a base web of inorganic fibers impregnated with a modified asphaultic matrix material, said modified asphaultic matrix material including asphalt and a flexibility improving additive; said elongate sheet being transversely back folded on itself at plural centrally disposed spaced apart transverse fold lines intermediate the length of said sheet to define a central transverse comparatively thickened portion for said ridge cover, said elongate sheet defining a T-shaped slit allowing said comparatively thickened portion to also fold double on itself in response to said elongate sheet being folded lengthwise, and said elongate sheet further defining plural spaced apart centrally disposed transverse grooves each extending across said elongate sheet from side to side thereof for defining respective locations of said plural transverse fold lines.

Additional objects and advantages may be appreciated from a reading of the following detailed description of a single exemplary and preferred embodiment of the invention taken in conjunction with the following drawing Figures, in which:

BRIEF DESCRIPTION OF THE DRAWING FIGURES

FIG. 1 provides a fragmentary perspective view of plural ridge covers embodying the present invention installed on a roof;

FIG. 2 is an enlarged fragmentary perspective view of the ridge covers seen in FIG. 1, and as they might appear during installation;

FIG. 3 provides a plan view of plural ridge covers embodying the present invention as they are generally folded and disposed adjacent one another during shipping;

FIG. 4 provides a top plan view of an elongate sheet or strip of shingle material at an intermediate stage of manufacture, and from which several individual work pieces will be separated for further processing into ridge covers embodying the present invention;

Figure 3:
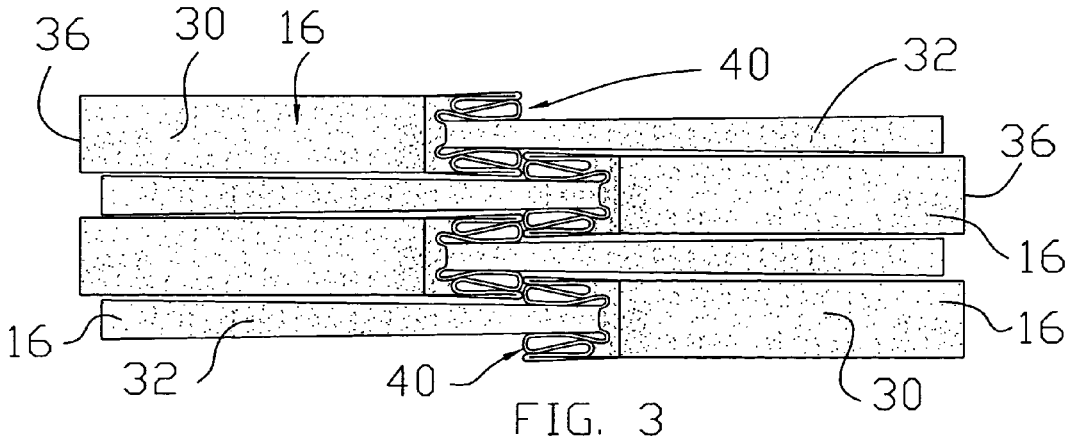
Figure 6:
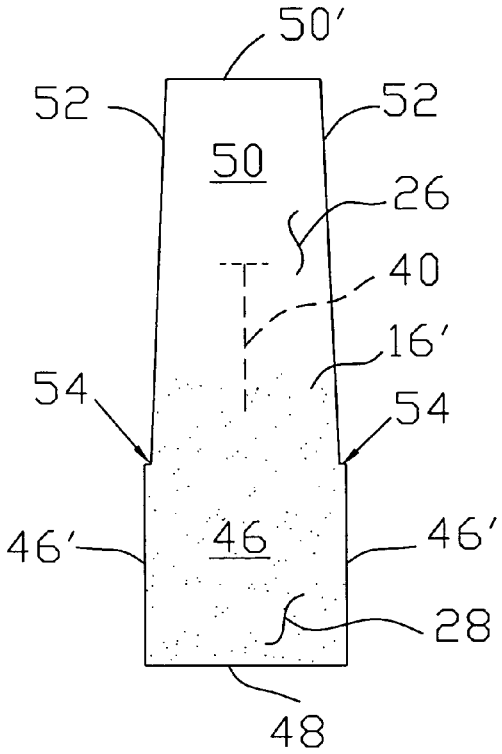
FIG. 6 is a top plan view of a single work piece, which upon further processing will become a ridge cover embodying the present invention.
Figure 7:
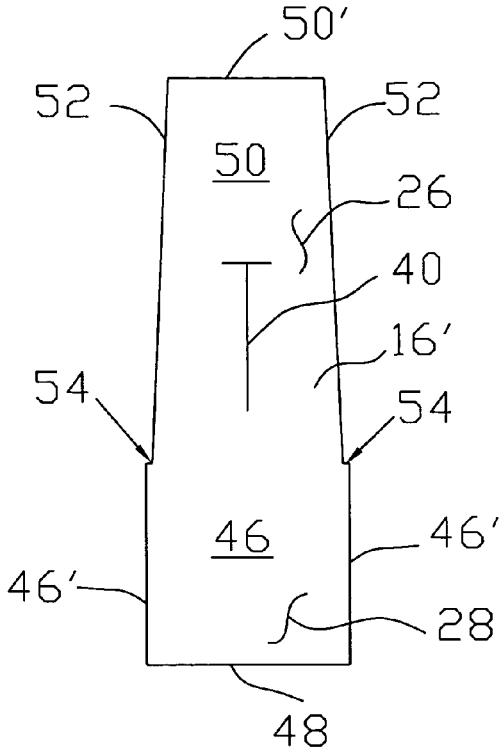
FIG. 7 is a bottom or underside plan view of the single work piece seen in FIG. 6.
Figure 8:
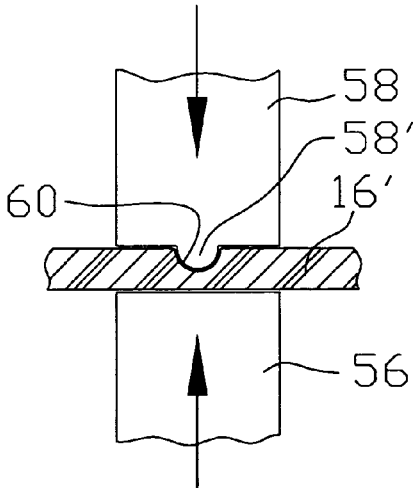
Figure 9:
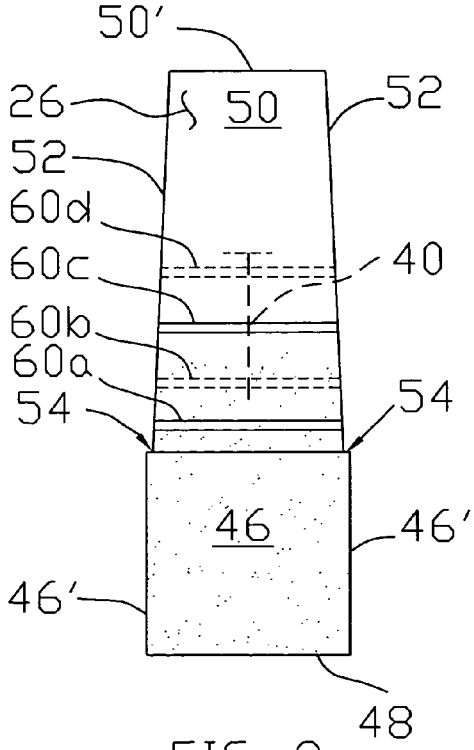
Figure 10:
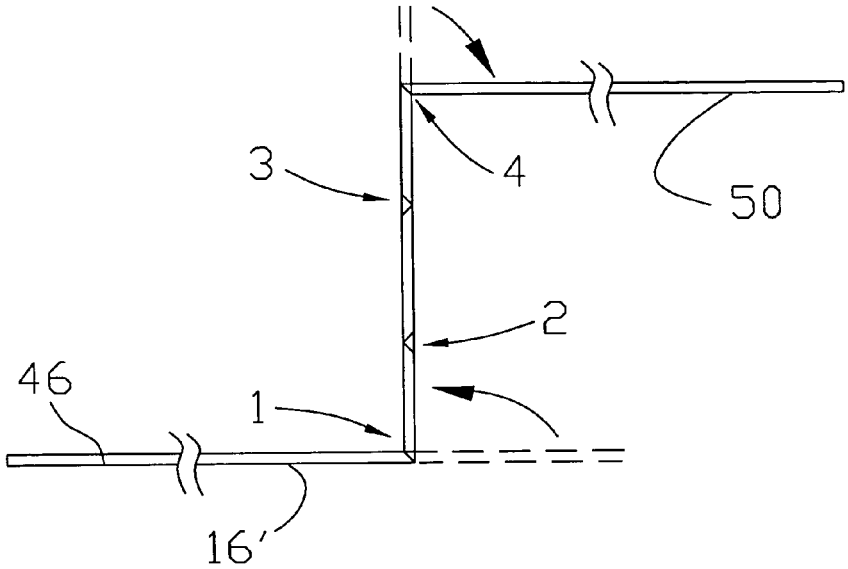
Figure 11:
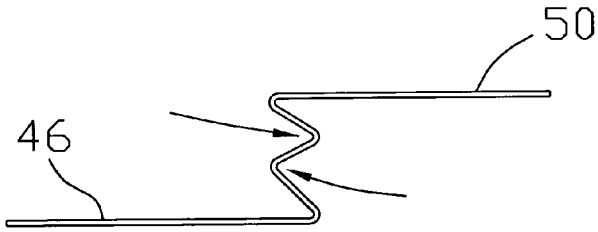
Figure 12:
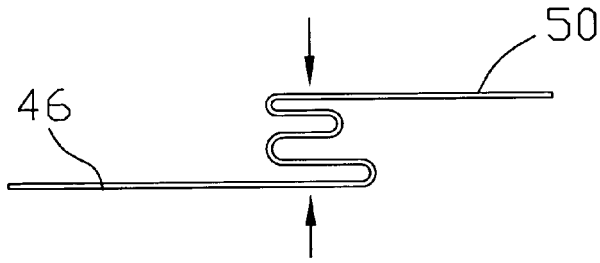
Figure 13:
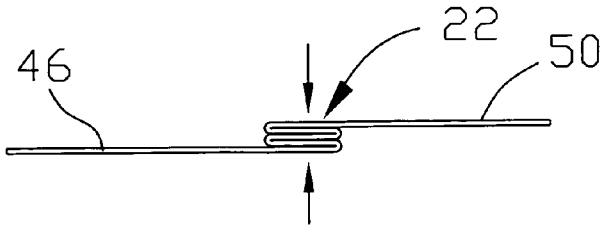
Figure 14:
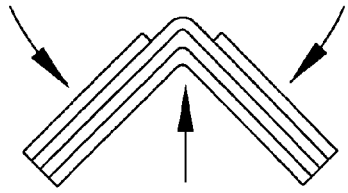
Figure 14A:
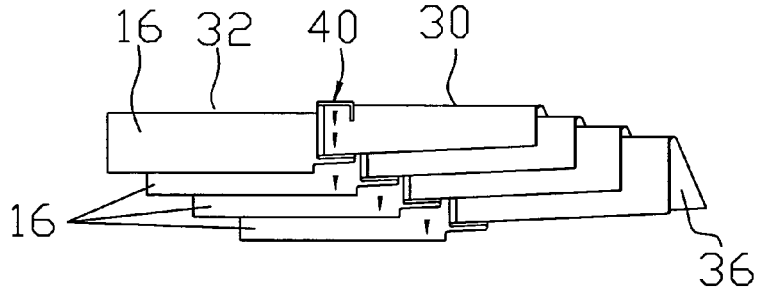
Figure 15:
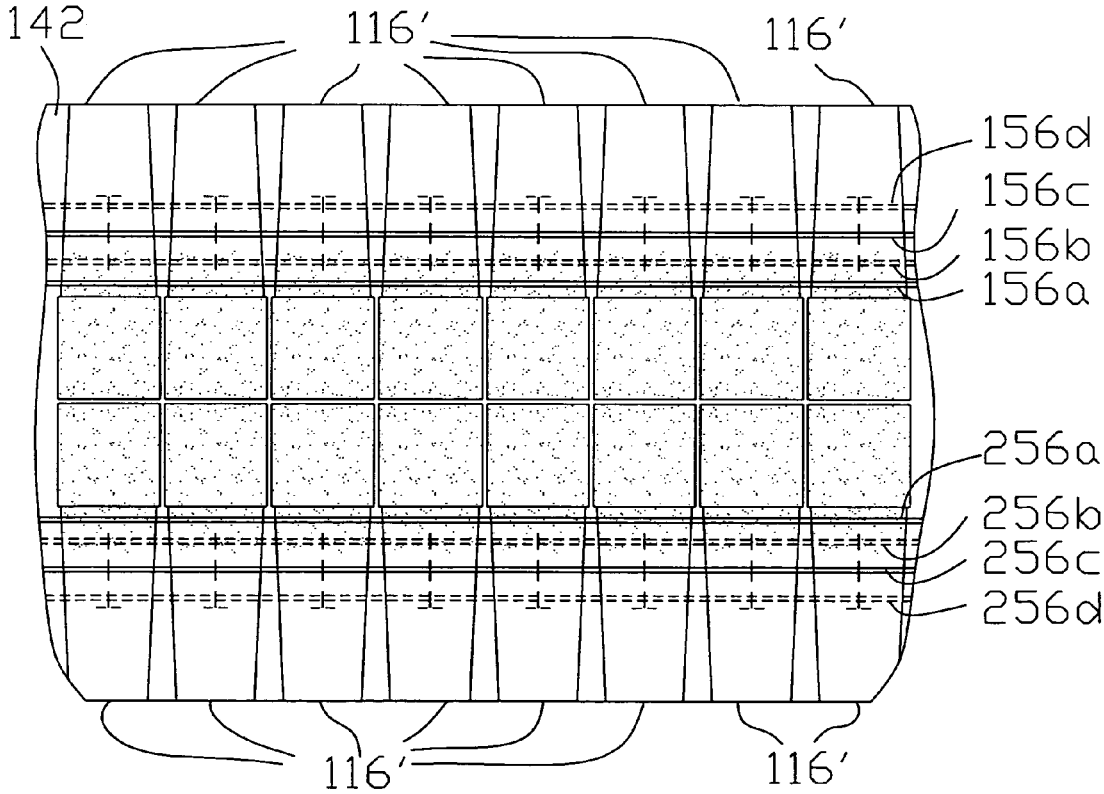

FIG. 8 diagrammatically illustrates a step in the processing of the work piece of FIGS. 6 and 7;

FIG. 9 is a top plan view of the work piece of FIGS. 6 and 7 after further processing in accord with the processing step depicted in FIG. 8;

FIG. 10 is a diagrammatic side elevation view of the workpiece of FIG. 9, during a subsequent stage (i.e., first phase folding) of manufacturing;

FIG. 11 provides a further diagrammatic side elevation view of the workpiece of FIG. 10, and at a further subsequent stage of manufacturing;

FIG. 12 illustrates the workpiece of FIG. 11 in side elevation view and during a still further step of manufacturing;

FIG. 13 provides a side elevation view of the work piece of FIG. 12 during the completion of a first phase of folding of the manufacturing process;

FIG. 14 provides an end elevation view of the work piece of FIG. 13 during a last phase folding of the workpiece, resulting upon completion of this folding in a folded ridge cover as is seen in FIG. 3;

FIG. 14*a* illustrates diagrammatically, a grouped or nested lengthwise folding of plural ridge covers in a group, which nested group of ridge covers is then packed into a shipping carton together; and FIG. 15 provides a top plan view of an alternative embodiment of an elongate sheet or strip of shingle material at an intermediate stage of manufacture, and from which several individual work pieces will be separated for further processing into ridge covers embodying the present invention.

DESCRIPTION OF PREFERRED EXEMPLARY EMBODIMENTS OF THE INVENTION

Figure 1:
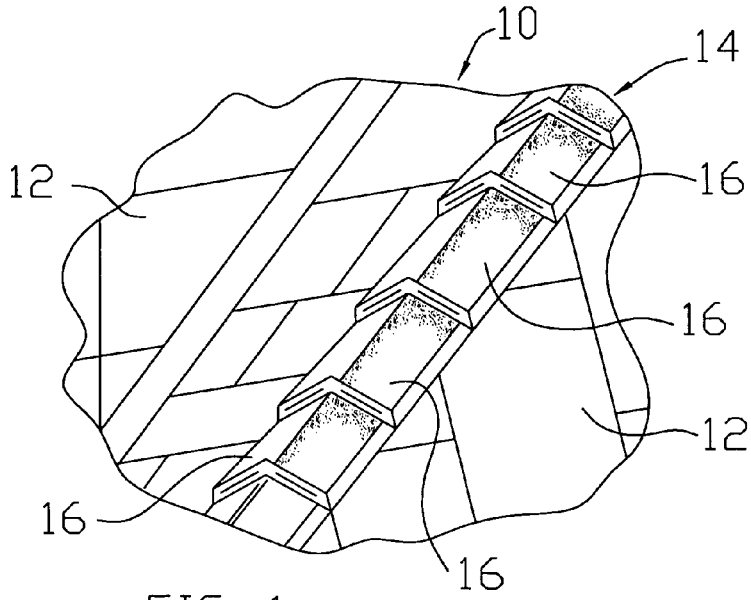

Viewing FIG. 1, a roof 10 is seen to include a pair of generally planar and conventional shingle-covered inclined surfaces or fields 12, which intersect with one another at an inclined hip 14. At the hip 14, the roof 10 includes a plurality of aligned and partially overlapping ridge cover members 16. Those ordinarily skilled in the pertinent arts will appreciate that the same type of ridge cover member 16 employed at the hip 14 may be used also at the ridges and rakes (not shown) of the roof 10.

Figure 2:
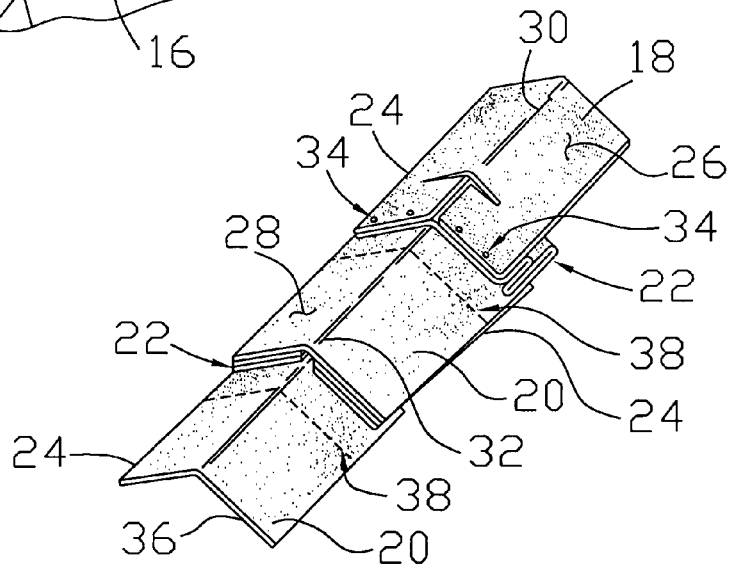

As is more particularly shown in FIG. 2, as they are installed on the roof 10, the ridge cover members 16 each include a chevron-shaped sheet-like upper portion 18 and a similar chevron-shaped sheet-like lower portion 20, which upper and lower portions are connected by a centrally disposed thickened portion 22. The thickened portion 22 is thickened by repeated back folding of the sheet material (which sheet material is generally referenced with the numeral 24) from which the ridge cover 16 is formed. Because this sheet material 24 is generally in the range of from one-eight to three-sixteenth of an inch thick, and the thickened portion 22 is preferably formed by back folding the material 24 four times on itself, the portions 18 and 20 define respective upper surfaces 26, and 28 which are spaced apart perpendicularly to the plane of the sheet material 24 by four times the thickness of the sheet material 24. That is, the upper surfaces 26, and 28 are spaced out of plane with each other by a dimension preferably in the range of from about one-half inch to about three-forth inch. Also, the upper portion 18 and lower portion 20 define respective longitudinal fold lines 30 and 32 which are similarly spaced apart from each other in a direction perpendicular to the fold lines.

On the roof 10 successive ridge cover members are installed upwardly along the hip 14 by nailing through the thickened portion 22 as is shown with the exposed nail heads 34 on one ridge cover, or alternatively, by nailing above the thickened portion 22 through the lower part of the portion 18, viewing particularly FIG. 2. Each ridge cover 16 is installed with the lower portion 20 of the particular ridge cover overlapping the upper portion 18 of the preceding ridge cover to cover the nail heads exposed on this preceding ridge cover. In fact a lower or front end edge 36 of each successive ridge cover member 16 extends slightly downslope or beyond the thickened portion 22 of the preceding ridge cover member. Consequently, the ridge covers 16 as installed on roof 10, provide a shadow, referenced on the drawing Figures with the numeral 38, falling on the lower portion 20 of the next lower ridge cover. Those ordinarily skilled in the pertinent arts will recognize that the existence and extent of the shadows 38 depends on the ambient lighting conditions, and that these shadows generally will be similar aesthetically to that of a wood shake roof at a hip, ridge, or rake of a roof.

FIG. 3 illustrates a plurality of ridge covers embodying the present invention as they are folded and nested together for shipping to a job site (i.e., in a cardboard box, for example). It is to be noted that each ridge cover 16 is folded lengthwise on itself so that it is no longer chevron shaped. As so folded, the thickened central portion 22 is folded double on itself and is disposed between the lower extend of the upper portion 18 also folded lengthwise on itself. As is shown in FIG. 3, the folded ridge covers 16 each have a relatively thick end portion (i.e., the upper end of the ridge cover) and a relatively thinner end portion, which is the lower portion of each ridge cover. The ridge covers 16 are preferably nested together for shipping by alternately reversing the direction of successive ridge covers, as is seen in FIG. 3. As is further seen in FIG. 3, in order to accommodate folding the central thickened portion 22 double on itself, the upper portion 18 and part of the thickened portion 22 (which is folded repeatedly on itself) defines a T-shaped slit 40, which will be further illustrated and described below. As is seen in FIG. 3, the T-shaped slit 40 allows the upper portion 18 and the central portion 22 to partially open up as it is folded about the thickened central portion 22 (that is, as the thickened central portion 22 is folded double on itself).

Figure 4:
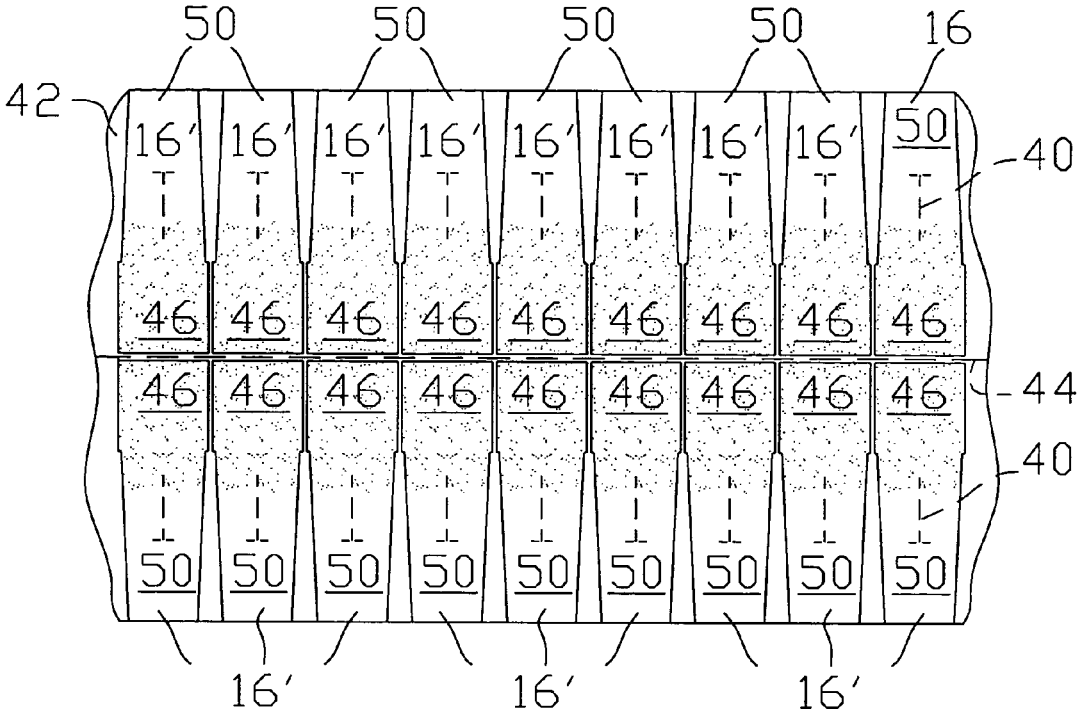
Figure 5:
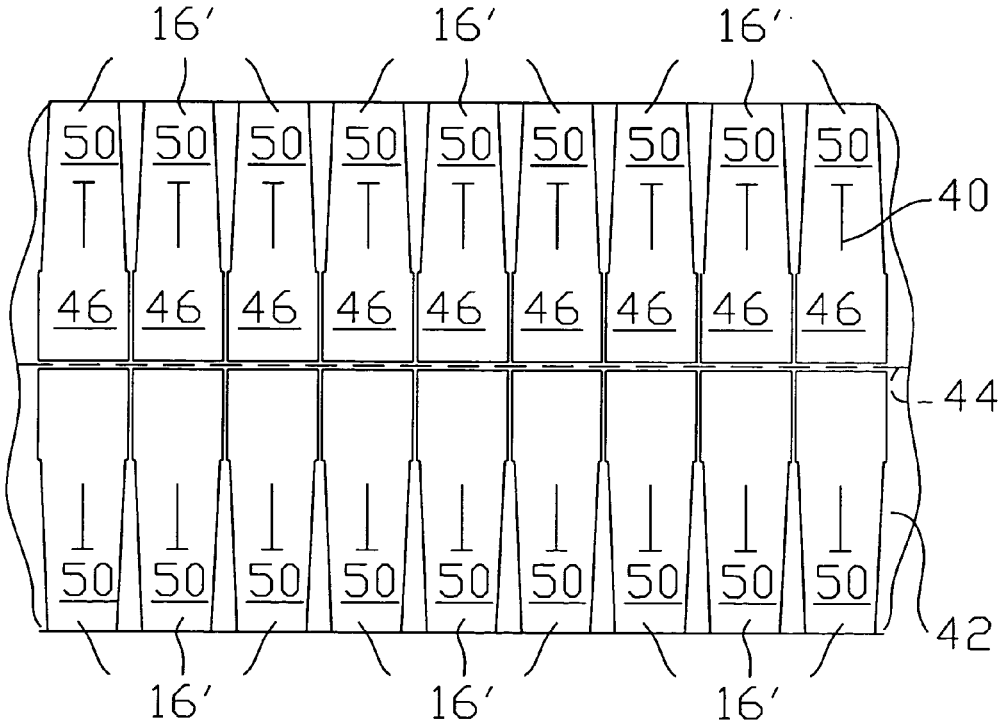
FIG. 5 is a bottom or underside plan view of the strip of shingle material seen in FIG. 4.

Turning now to FIGS. 4 and 5, a manufacturing intermediate article 42 for the ridge cover 16 is diagrammatically depicted. FIG. 4 shows the top side (or side coated with granular material), while FIG. 5 shows the bottom side of this manufacturing intermediate article. On the top side view of the article 42, the T-shaped slit 40 appears as a dashed line on each work piece 16'. However, on the bottom side view of FIG. 5, the T-shapes slits 40 appear as solid lines, because these T-shaped slits are defined by shallow cuts impressed into the material 24 of the article 42. Moreover, the manufacturing intermediate article 42 is an elongate strip or ribbon of sheet-like shingle material, from which several individual ridge covers 16 will be formed after further manufacturing or processing. That is, as is seen by the outlines drawn on this diagrammatic depiction of the sheet like shingle material work piece 42, plural individual work pieces 16' are oppositely disposed in somewhat of a mirror image fashion generally on opposite sides of an elongate centerline 44 of this work piece.

FIGS. 6 and 7 respectively show top side and bottom side plan views of an individual one of the work pieces 16. As is to be noted viewing FIG. 7, the work pieces 16' include a T-shaped slit 40. However, in contrast to the conventional technology, no plurality of spaced apart transverse score lines or slits are needed in order to insure that the work piece 16' will fold on itself at these locations. A different structure and different method of folding is effected by the present invention in order to repeatedly form the back folded thickened portion 22 of each successively manufactured ridge cover 16. The structure and method of back folding the thickened portion 22 according to the present invention achieves sufficient precision in the location of each back fold without the use of transverse folding slits. Further viewing the work piece 16' it is seen that it has a generally rectangular lower portion 46 (which is preferably square in the illustrated embodiment). This lower portion has an end edge 48 which is most preferable 8 inches in width. The end portion 46 has a pair of opposite side edges 46' which are each preferably 8 inches in length. The work piece has an overall length preferably of about 26 inches, and has a tapering upper end portion 50 with a width of about 6⅛ inch at the end edge 50' The tapering upper end portion has a pair of opposite side edges 52, which define slight steps or notches (each indicated with the arrowed numeral 54) of about ¼ inch dimension in the width direction of the ridge cover work piece 16'.

FIG. 8 provides a side elevation view of a work piece 16' during a step of the manufacturing process toward a completed ridge cover 16. As can be seen in FIG. 8, a support member 56 engages against one face of the work piece 16' (i.e., in this case, against the back or bottom surface of the work piece) while an impressing member 58 engages against the opposite face of the work piece 16' (i.e., in this case, against the top or upper surface of the work piece). The member 58 defines or carries a protruding rib portion 58', which impresses into the work piece 16'. Most preferably, the members 56 and 58 (i.e., from the portion 58') are separated by a gap of about 0.030 inches at their closest (i.e., between the rib portion 58' and the support member 56), so that a transverse groove 60 is impressed into the material 24 of the work piece 16'. This transverse groove extends preferably from side to side of the work piece. Importantly, the relatively dull impressing portion 58' of member 58 impresses the groove 60 across the work piece from side to side substantially without cutting through the work piece and substantially without cutting internal fibers of this work piece. That is, the fibers of the inorganic fibrous mat from which the sheet shingle material 24 of work piece 16' is made (i.e., along with flexibility improved asphalt and granular materials) are not significantly cut or broken by this impressing operation. The members 56 and 58 are shown respectively on the underside and on the top side of the work piece 16', but this relative position may be reversed in order to impress a groove across the underside of the work piece 16'.

FIG. 9 provides a top plan view of the work piece 16' subsequent to forming of four side to side impressed transverse grooves (indicated with the arrowed numerals 60*a*, 60*b*, 60*c*, and 60*d*). The grooves 60*a*–6*d* extend substantially perpendicularly to a length dimension of the work piece 16' That is, the grooves 60*a*–6*d* extend substantially parallel to the end edges 48 and 50'. These grooves 60 are located at the sites of the desired folds in order to back fold the work piece 16' in itself and to thus form the thickened portion 22 of the finished ridge cover 16, recalling the description above. Further, each alternate groove is formed on the underside of the work piece 16'. That is, grooves 60*a* and 60*c* are formed on the top face of the work piece 16', while grooves 60*b*, and 60*d* are formed on the lower face of the work piece 16'.

Turning now to FIG. 10, a diagrammatic side elevation view of the work piece 16' during the formation of a first two of the back folds which will form the thickened section 22 is illustrated. For purposes of this explanation, the grooves 60*a*–60*d* have been indicated with arrowed numerals 1–4. As is seen in FIG. 10, a first fold of substantially 90° is formed at the location of groove 1, and a second fold of substantially 90° in the opposite direction is formed at the location of groove 4. These folds may be formed in the opposite order or may be formed simultaneously. Importantly, the folds at locations of grooves 1 and 4 results in the work piece 16' now having substantially a Z-shape (albeit a Z-shape on its side as seen in FIG. 10).

Next, as is seen in FIG. 11, oppositely directed forces are applied intermediate of the folds 1 and 4, generally parallel to the planes of the portions 18 and 20, and at the locations of the folds 2 and 4, to again cause folds to begin forming at the locations of transverse grooves impressed earlier in the manufacturing operation. In this case, oppositely disposed grooves are forming at the locations of grooves 2 and 3.

Subsequently, as is seen in FIG. 12, vertically directed forces are applied to collapse the back folded portion 22 on itself. That is, the mere beginnings of the formation of the folds at locations 2 and 3 (especially with folds 1 and 4 being 90° folds), followed by the application of the vertically directed forces indicated by the arrows on FIG. 12, is sufficient to cause the back folded portion 22 to form and collapse on itself.

FIG. 13 depicts the additional application of finishing vertically directed forces to press the back folded portion 22 into a compact back folded (i.e., accordion folded) structure.

FIG. 14 is an end elevation view of the backfolded work piece 16' subsequent to the step shown in FIG. 13, and during a lengthwise folding step to result in the ridge cover seen in FIG. 3. During this lengthwise folding step, each side of the work piece is subjected to a downwardly directed force, while an upwardly directed force is applied centrally along the length of the workpiece. Consequently, the T-shaped slit opens (recalling the description above) and a ridge cover as seen in FIG. 3 results, ready to be packed into a box for shipping to a job site where it is installed on a roof as described above.

FIG. 14*a* illustrates diagrammatically that alternatively, a nested group of plural ridge covers 16 (in this case, four nested ridge covers 16, although the invention is not so limited) may be stacked in a staggered group such that the thickened portions 22 abut one another, and the group is then folded lengthwise in order to form a packing unit of plural nested ridge covers, as is depicted in FIG. 14*a*. This packing unit is then packed into a box or cartion, as was explained with reference to FIG. 3, and successive packing groups of plural ridge covers are reversed in direction in the carton so that they nest together in plan view much as was depicted and described by reference to FIG. 3.

FIG. 15 illustrates an alternative method of manufacturing the ridge covers 16 according to this invention. As is seen in FIG. 15, a manufacturing intermediate article 142 is in all respects the same as the manufacturing intermediate article 42 depicted and described above, and includes plural work pieces 116, except that the article 142 has impressed into it eight elongate grooves (indicated with numerals 156*a*–156*d* and 256*a*–256*d*) extending parallel to the centerline 144, and each groove 156/256 has a location corresponding to one of the grooves 60*a*–6*d* described above. In other words, the elongate grooves 156*a*–156*d* and 256*a*–256*d* cross the individual work pieces 116 at the locations of grooves 60*a*–6*d*, but are continuous grooves extending all along the length of the manufacturing intermediate article 142. After the individual work pieces 116 are separated out of the article 142, these individual work pieces may be folded at the locations of grooves 156*a*–156*d* (or at 256*a*–256*d*) in order to form ridge covers 16 which are finished by the lengthwise folding step indicated in FIG. 14.

While the present invention has been depicted, described, and is defined by reference to a particularly preferred embodiment of the invention, such reference does not imply a limitation on the invention, and no such limitation is to be inferred. The invention is capable of considerable modification, alteration, and equivalents in form and function, as will occur to those ordinarily skilled in the pertinent arts. The depicted and described preferred embodiment of the invention is exemplary only, and is not exhaustive of the scope of the invention. Consequently, the invention is intended to be limited only by the spirit and scope of the appended claims, giving full cognizance to equivalents in all respects.

We claim:

1. A folded ridge cover comprising:

an elongate sheet of flexible composition sheet shingle material;

said elongate sheet being transversely back folded on itself at plural centrally disposed spaced apart transverse fold lines intermediate the length of said sheet to define a central transverse thickened portion for said ridge cover, said elongate sheet defining a T-shaped through slit allowing said comparatively thickened portion to also fold double on itself in response to said elongate sheet being folded lengthwise, and said elongate sheet further defining plural spaced apart centrally disposed transverse impressed grooves which do not penetrate through said sheet shingle material so that said sheet shingle material is free of transverse slits, and which impressed grooves also do not remove material from said sheet shingle material so that said sheet shingle material is free of transverse scores, with each transverse impressed groove extending across said elongate sheet from side to side thereof and each for defining respective locations of said plural transverse fold lines.

2. The ridge cover of claim 1 wherein said elongate sheet includes a base web of inorganic fibers impregnated with a modified asphaltic matrix material, said modified asphaltic matrix material includes asphalt and a flexibility improving additive.

3. The ridge cover of claim 1 wherein said elongate sheet includes a rectangular end portion joining with a tapering opposite end portion.

4. The ridge cover of claim 3 wherein said opposite end portion is of trapezoidal shape.

5. The ridge cover of claim 1 wherein said plurality of transverse grooves transects said T-shaped slit.

6. The ridge cover of claim 3 wherein said rectangular end portion is square in shape.

7. The ridge cover of claim 6 wherein said end portion and said opposite end portion cooperatively define a pair of opposite side steps along the length of said elongate work piece, and said pair of side steps are generally disposed along the length of said work piece adjacent to a bottom of said T-shaped slit.

8. A ridge cover work piece, said work piece comprising:

an elongate sheet of composition sheet shingle material;

said elongate sheet defining a T-shaped slit and further defining plural spaced apart centrally disposed transverse grooves each extending across said elongate sheet from side to side thereof each for defining a respective location for one of plural transverse fold lines;

said plural spaced apart centrally disposed transverse grooves being impressed grooves which do not penetrate through said sheet shingle material so that said sheet shingle material is free of transverse slits, and said impressed grooves also not removing material from said sheet shingle material so that said sheet shingle material is also free of transverse scores, with each of said plural transverse impressed groove extending across said elongate sheet from side to side thereof and each serving to define a respective location of a transverse fold line;

said elongate sheet including a rectangular end portion joining with a tapering opposite end portion, and said plurality of transverse grooves transecting said T-shaped slit.

9. As an article of manufacture, a manufacturing intermediate article for making plural centrally-folded and centrally-thickened ridge covers, said manufacturing intermediate article comprising:

an elongate strip of composition shingle roofing material, said elongate strip including plural oppositely disposed ridge cover work pieces integrally joined together to define a longitudinal centrally disposed line of symmetry for said article of manufacture, and each ridge cover work piece including a lower portion having an end edge of certain dimension, and an upper portion having an end edge of lesser dimension, said lower portion end edge and said upper portion end edge being joined by work piece side edges so that each of said plural oppositely disposed ridge covers work pieces is defined by a respective trapezoidally-shaped sheet disposed transversely to said elongate strip of shingle roofing material, and each ridge cover work piece defining a T-shaped longitudinal slit having a cross bar portion disposed toward said upper end portion of said ridge cover work piece, and each of said plural ridge cover work pieces being free of transverse slits aligned to transect said T-shaped slit.

10. The article of manufacture of claim 9 wherein said trapezoidally-shaped sheet is also free of score lines aligned to transect said T-shaped slit.

11. The article of manufacture of claim 9 wherein each of said plural work pieces defines plural elongate grooves alternatingly disposed on a top and on a bottom of said work pieces, and each defining a location for a transverse fold line for the work pieces.

12. A method of providing a centrally-folded and thickened ridge cover of sheet shingle material, said method comprising the steps of:

providing a work piece for said ridge cover, and configuring said work piece to have a lower portion and an upper portion, defining a T-shaped slit in said work piece, and defining plural transverse grooves transecting said T-shaped slit;

bending said work piece at a first of said plural transverse grooves and at a last of said plural transverse grooves so that said work piece has a Z-shape in side elevation view;

applying oppositely directed folding forces to said work piece substantially at the locations of each of said transverse grooves intermediate of said first and last groove so that said work piece takes a zigzag shape along the center bar of said Z-shape; and applying oppositely directed collapsing forces to the top and bottom bar of said Z-shaped work piece so that the center bar collapsed from said zigzag shape to form plural back folds on itself intermediate of said upper and lower portions;

wherein said step of defining one of said plural transverse grooves in said work piece includes the steps of supporting said work piece on one face with a supporting member, and impressing an impressing member into an opposite face of said work piece in alignment with said supporting member to form said transverse groove;

including the steps of configuring each of said supporting member and said impressing member as a roller or wheel.

13. The method of claim 12 including the steps of including a radially protruding rib on said impressing member.

14. The method of claim 13 including configuring said impressing member to have a substantially flat face above which said protruding rib extends radially.

15. The method of claim 12 including the step of maintaining a separation between said supporting member and said impressing member of about 0.030 inch.

* * * * *